US006585861B2

(12) United States Patent
Odhe et al.

(10) Patent No.: US 6,585,861 B2
(45) Date of Patent: Jul. 1, 2003

(54) DEVICE FOR PRODUCING AN EXTENSIBLE PAPER HAVING A THREE-DIMENSIONAL PATTERN

(75) Inventors: Janerik Odhe, Kristinehamn (SE); Bengt Järrehult, Göteborg (SE); Holger Hollmark, Stockholm (SE); Lennart Reiner, Karlstad (SE); Thomas Billgren, Kullavik (SE); Ingvar Klerelid, Karlstad (SE)

(73) Assignee: Metso Paper Karlstad AB, Karlstad (SE)

( * ) Notice: Subject to any disclaimer, the term of this patent is extended or adjusted under 35 U.S.C. 154(b) by 0 days.

(21) Appl. No.: 10/020,885

(22) Filed: Dec. 19, 2001

(65) Prior Publication Data

US 2002/0079078 A1 Jun. 27, 2002

Related U.S. Application Data

(60) Provisional application No. 60/256,310, filed on Dec. 19, 2000.

(30) Foreign Application Priority Data

Dec. 19, 2000 (SE) ..... 0004721

(51) Int. Cl.[7] ..... D21G 3/04; D21F 5/02

(52) U.S. Cl. ..... 162/280; 162/281; 162/361; 162/362; 34/108; 34/132; 156/160; 100/329

(58) Field of Search ..... 162/361–362, 162/358.5, 280, 281, 111, 109, 117; 34/397–400, 419, 423, 424–426, 442, 446, 104, 143, 611, 116, 123, 132, 108; 156/209, 199, 160; 100/172, 327–330

(56) References Cited

U.S. PATENT DOCUMENTS

| | | | | | |
|---|---|---|---|---|---|
| 3,301,746 | A | | 1/1967 | Sanford et al. | |
| 4,324,613 | A | * | 4/1982 | Wahren | 162/111 |
| 5,126,015 | A | * | 6/1992 | Pounder | 162/206 |
| 5,439,559 | A | * | 8/1995 | Crouse | 162/358.5 |
| 5,556,511 | A | * | 9/1996 | Bluhm et al. | 162/206 |
| 5,598,642 | A | * | 2/1997 | Orloff et al. | 34/388 |
| 6,146,499 | A | * | 11/2000 | Lin et al. | 162/197 |
| 6,223,450 | B1 | * | 5/2001 | Banerjee | 34/116 |
| 6,309,512 | B1 | * | 10/2001 | Bengtsson et al. | 162/358.5 |
| 6,372,090 | B1 | * | 4/2002 | Laapotti | 162/206 |
| 6,416,623 | B1 | * | 7/2002 | Hollmark et al. | 162/109 |
| 6,447,643 | B2 | * | 9/2002 | Fingal et al. | 162/109 |
| 6,454,895 | B1 | * | 9/2002 | Weder | 156/209 |
| 6,454,905 | B1 | * | 9/2002 | Hollmark et al. | 162/206 |
| 6,503,370 | B2 | * | 1/2003 | Hollmark et al. | 162/117 |
| 2002/0092633 | A1 | * | 7/2002 | Odhe et al. | 162/111 |
| 2002/0124978 | A1 | * | 9/2002 | Hollmark et al. | 162/109 |

FOREIGN PATENT DOCUMENTS

| | | |
|---|---|---|
| EP | 490655 | 6/1992 |
| SE | 423118 | 4/1982 |
| WO | 95/34711 | 12/1995 |
| WO | 99/34055 | 7/1999 |

* cited by examiner

*Primary Examiner*—Jose A. Fortuna
(74) *Attorney, Agent, or Firm*—Burns, Doane, Swecker & Mathis, L.L.P.

(57) ABSTRACT

Device for producing a paper having a three dimensional pattern which has been given the paper web in connection with drying the paper web. The device comprises at least one press nip (12) comprising a rotatable heated roll (13) and a counter means (11,14), at which either the heated roll (13) along its periphery alternatively a member surrounding the roll or a patterned wire, band or belt is provided with said three dimensional pattern, and wherein the wet paper web (10) is intended to pass through said press nip (12) and is given said pattern A detaching roll (16) is arranged at a certain distance from the press nip (12) for taking off the paper web from the heated roll (13), and creping means (17) are arranged for creping the paper from said detaching roll (16).

4 Claims, 1 Drawing Sheet

DEVICE FOR PRODUCING AN EXTENSIBLE PAPER HAVING A THREE-DIMENSIONAL PATTERN

This application claims benefit of provisional application 60/256,310 filed Dec. 19, 2000.

TECHNICAL FIELD

The present invention refers to a device for producing a paper having a three dimensional pattern of alternating raised and recessed portions, which has been provided in connection with drying of the paper web, said device comprising at least one press nip comprising a rotatable heated roll and a counter means, at which either the heated roll along its periphery alternatively a member surrounding the roll or a patterned wire, band or belt is provided with said three dimensional pattern, and wherein the wet paper web is intended to pass through said press nip and is given said pattern.

BACKGROUND OF THE INVENTION

Moist paper webs are usually dried against one or more heated rolls. A method which is commonly used for tissue paper is so called Yankee drying. At Yankee drying the moist paper web is pressed against a steam-heated Yankee cylinder, which can have a very large diameter. Further heat for drying is supplied by blowing of heated air. If the paper to be produced is soft paper the paper web is usually creped against the Yankee cylinder. The drying against the Yankee cylinder is preceded by a vacuum dewatering and a wet pressing, in which the water is mechanically pressed out of the paper web.

Another drying method is so called through-air-drying (TAD). In this method the paper is dried by means of hot air which is blown through the moist paper web, often without a preceding wet pressing. The paper web which enters the through-air-dryer is then only vacuum dewatered and has a dry content of about 25–30% and is dried in the through-air-dryer to a dry content of about 65–95%. The paper web is transferred to a special drying fabric and is passed over a so called TAD cylinder having an open structure. Hot air is blown through the paper web during its passage over the TAD cylinder. Paper produced in this way, mainly soft paper, becomes very soft and bulky. The method however is very energy-consuming since all water that is removed has to be evaporated. In connection with the TAD drying the pattern structure of the drying fabric is transferred to the paper web. This structure is essentially maintained also in wet condition of the paper, since it has been imparted to the wet paper web. A description of the TAD technique can be found in, e.g., U.S. Pat. No. 3,301,746.

Impulse drying of a paper web is disclosed in, e.g., SE-B-423 118 and shortly involves that the moist paper web is passed through the press nip between a press roll and a heated roll, which is heated to such a high temperature that a quick and strong steam generation occurs in the interface between the moist paper web and the heated roll. The heating of the roll is, e.g., accomplished by gas burners or other heating devices, e.g., by means of electromagnetic induction. By the fact that the heat transfer to the paper mainly occurs in a press nip an extraordinarily high heat transfer speed is obtained. According to a theory all water that is removed from the paper web during the impulse drying is not evaporated, but the steam on its way through the paper web carries along water from the pores between the fibers in the paper web. The drying efficiency becomes by this very high.

In EP-A-0 490 655 there is disclosed the production of a paper web, especially soft paper, where the paper simultaneously with impulse drying is given an embossed surface. This embossment is made by pressing a pattern into the paper from one or both sides against a hard holder-on. This gives a compression of the paper and by this a higher density in certain portions just opposite the impressions and a lower density in the intermediate portions.

In the international patent application no. PCT/SE98/02461 there is disclosed a method for producing an impulse dried paper, especially soft paper, having a three-dimensional pattern, said paper having high bulk and softness. The paper is produced according to the method stated in the introduction, at which the counter means against which the paper is pressed in connection with the simultaneous impulse drying and shaping, has a non-rigid surface so that the paper is given a three-dimensional structure having a total thickness greater than the thickness of the unpressed paper web.

THE OBJECT AND MOST IMPORTANT FEATURES OF THE INVENTION

There is however still a need to further improve and adapt the paper quality to special fields of application. The object of the present invention is to provide a device for producing a paper that has been dried at a high temperature in a press nip and having a three-dimensional pattern, e.g., a soft paper intended as toilet paper, kitchen rolls, paper handkerchiefs, table napkins and other wiping material, and where the paper besides a high bulk and a high softness also has a high extensibility. This has according to the invention been provided by the fact that a detaching roll is arranged at a certain distance from the press nip for taking off the paper web from the heated roll, and that creping means are arranged for creping the paper from said detaching roll.

According to a preferred embodiment of the invention the angular distance, with respect to the heated roll, between the press nip and the detaching roll is at least 45°, preferably at least 60°, at which the paper web is led between the press nip and the detaching roll around a part of the periphery of the heated roll in order to provide an after-drying of the paper web while this is still in contact with the three-dimensional pattern of the roll.

The detaching roll is according to an embodiment of the invention heated.

Further features and advantages of the invention are disclosed in the following description and in the dependant claims.

DESCRIPTION OF THE DRAWING

The invention will in the following be closer described with reference to an embodiment shown in the accompanying drawing.

DESCRIPTION OF THE INVENTION

Figure 1:
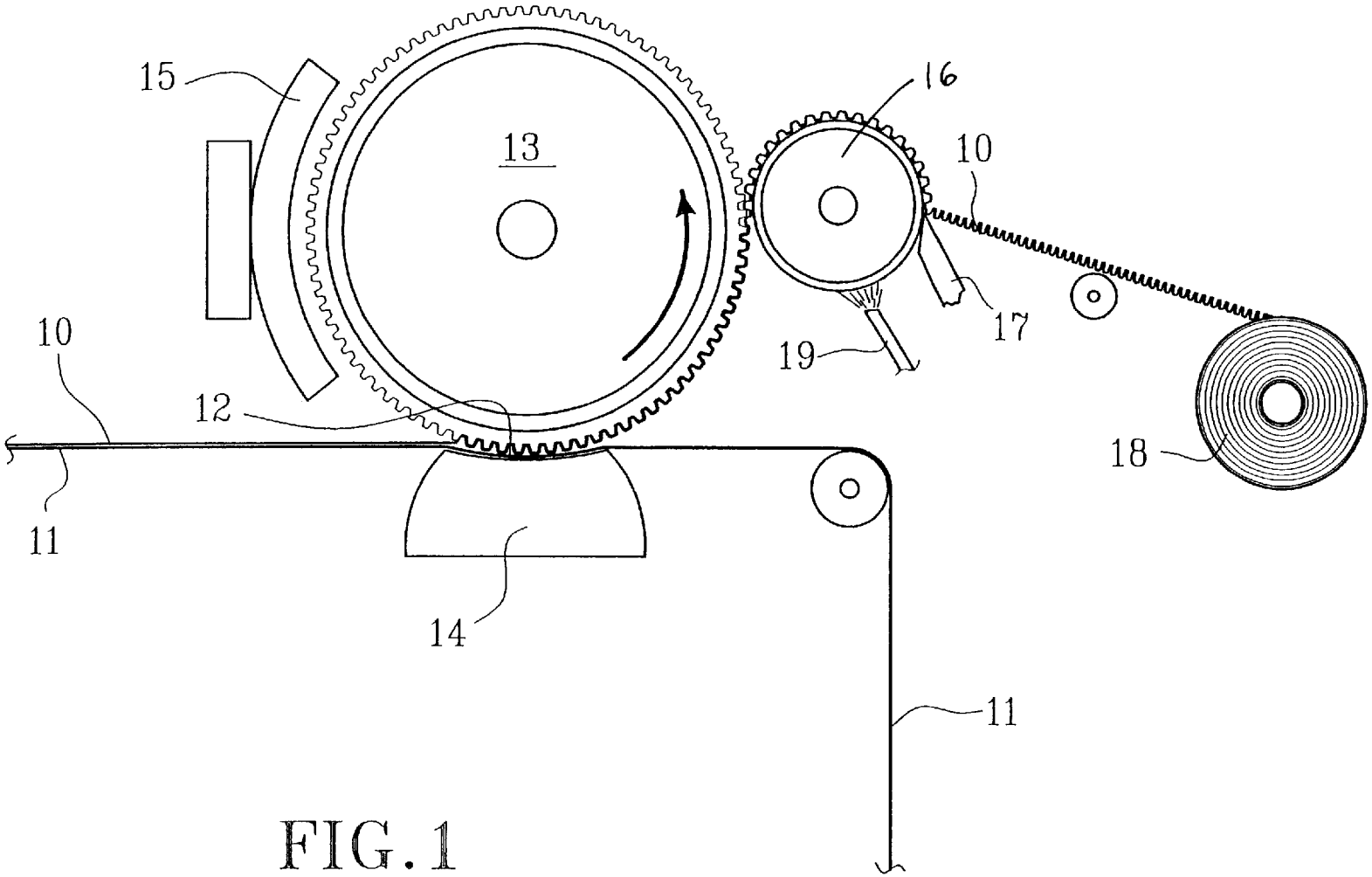
FIG. 1 is a schematic side view of an drying device according to the invention.

FIG. 1 shows schematically a device for producing a paper according to the invention. The wet paper web 10 which is dewatered over suction boxes (not shown) and possibly also slightly pressed, is supported by a wire or felt 11 and is led into a press nip 12 between a rotatable roll 13 and a counter means 14 in the form of a rotatable roll or a press band running over a stationary press shoe, at which the roll 13 which is in direct contact with the paper web is by a heating device 15 heated to a temperature which is sufficiently high for providing drying of the paper web. The surface temperature of the heated roll can vary depending on such factors as the moisture content of the paper web, thickness of the paper web, the contact time between the paper web and the roll and the desired moisture content of the completed paper web. The surface temperature should of course not be so high the paper web is damaged. An appropriate temperature should be in the interval 100–400° C., preferably 150–350° C. and most preferably 200–350° C.

By the fact that the heat transfer to the paper mainly takes place in a press nip a very rapid heat transfer rate an by that an effective drying is obtained. A very rapid, violent and almost explosive steam generation takes place in the interface between the heated roll 13 and the moist paper web. This drying procedure is often called impulse drying. The paper is at the exit of the press nip strongly heated, which means that the water that normally flows back into the paper web from the felt at the exit from a press nip, in this case is heated and surrounded by a protecting steam film, which prevents the water from being sucked back into the paper web again.

Besides the heated roll 13 the press nip also comprises a press shoe 14 or a counter roll. The press nip may be a common roll nip or a so called extended press nip in order to provide a more effective drying of the paper web. Two and more press devices may also be arranged after each other. It is also possible that the paper web 11 is brought into the press nip unsupported, i.e., not supported by any wire or felt.

The paper web 10 can according to an alternative embodiment after said press nip 12 be led around an essential part of the periphery of the heated roll 13 in order to provide an after-drying of the paper web while this is still in contact with three dimensional pattern of the roll 13. The paper is taken off from the heated pattern roll 13 by means of a detaching roll 16, which is located at a small distance from or in contact with the pattern roll 13, and is creped on the detaching roll 16 by means of a doctor blade 17. The doctor blade 17 can be of any optional type, flat as well a patterned, and the doctor blade angle can be adjusted for providing small or large creping creases. Through the creping the extensibility and softness of the paper is improved. Creping chemicals can in a per se known manner be applied, e.g., sprayed, on the detaching roll 16, the detaching roll 16 by means of an applicator means 19.

Alternatively the detaching roll 16 can be heated and the moisture content of the paper web when it reaches the detaching roll can be at least 10%, preferably at least 20%, at which final drying takes place on the detaching roll 16.

The angular distance between the press nip 12 and the detaching roll 16, with respect to the roll 13, corresponding to the distance that the paper web is led around the periphery of the pattern roll 13, is preferably at least 45°, more preferably at least 60°.

A further advantage with this arrangement is that the problem with taking off the paper web from the pattern roll 13 is solved. Since the paper web is pressed into the surface structure of the pattern roll it can sometimes be difficult to remove the paper from the roll 13. The removal of the paper web from the pattern roll 13 is considerably facilitated by the roll 16, which thus fills the function of both a detaching roll and a creping cylinder. The paper is after drying and creping rolled up on a wind-up roll 18.

Simultaneously with the drying in the press nip the paper is given a three-dimensional structure. This can be made as shown in FIG. 1 by the fact that the heated roll 13 is provided with an embossing pattern consisting of alternating raised and recessed areas. This pattern may be provided on a sleeve applied around the roll. This structure is substantially maintained also in a later wetted condition of the paper, since it has been imparted the wet paper web in connection with drying thereof. Since the term embossing is normally used for a shaping performed on dried paper we have in the following used the term press moulding for the three-dimensional shaping of the paper that occurs simultaneously with the drying in the press nip. By this press moulding the bulk and absorption capacity of the paper is increased, which are important qualities for soft paper.

The paper can at the drying in the press nip be pressed against a non-rigid surface, i.e., a compressible press felt 11. The band that runs over the press shoe 14 or the like can also have an elastically yielding surface, e.g., an envelope surface of rubber. The paper is herewith given a three-dimensional structure, the total thickness of which is greater than the thickness of the unpressed paper. By this the paper is imparted a high bulk and by that a high absorption capacity and a high softness. Besides the paper will be elastic. At the same time a locally varying density is obtain e d in t he paper.

The paper can also be pressed against a hard surface, e.g., a wire 11 and/or a roll 14 having a hard surface, at which the pattern of the heated roll 13 is pressed into the paper web under a heavy compression of the paper opposite the impressions, while the portions therebetween are kept uncompressed.

The pattern structure in the paper can also be made by means of a pattern band or belt (not shown)which extends around and is heated by the roll 13 and is led through the press nip 12 between the roll 13 and the paper web 10.

Alternatively the paper web 10 may during the drying be supported by a wire 11 having a pattern, which is press moulded into the paper web when this passes through the press nip 12. The paper web will in this case pass the press nip 12 between the roll 13 and the pattern wire. The roll 13 can either be smooth or have an embossing pattern. In the case the roll 13 is smooth the press moulded paper will have one smooth surface and one surface with impressions. In the case the roll 13 has an embossing pattern this will also be pressed into the paper, which thus on one side will have a pattern corresponding to the structure of the wire 11 and on the opposite side having a pattern corresponding to the embossing pattern of the roll. The patterns may but need not coincide and/or be the same or different.

Possibly the paper web can after the first press nip and before winding on the wind-up roll 16 be passed through a second press nip (not shown) where a second drying of the paper web takes place. This implies of course that the paper web before the second press nip is not completely dry but has a moisture content of at least 10 and preferably at least 20 weight %.

This can be achieved if the drying in the first drying step in the press nip 12 is not complete and/or by moistening the paper web before the second drying step.

Simultaneously with the two drying steps the paper web is given a three-dimensional structure. The patterns can be pressed into the paper web from opposite sides. It is of course also possible to press different patterns into the paper web from the same side. The patterns pressed into the paper web in the two drying steps are preferably different.

According to one embodiment of the invention a material may be added to the paper web, said material softens or melts in the temperature interval 100–400° C. Said material can be synthetic or natural polymers with thermoplastic properties, chemically modified lignin and/or synthetic or natural polymers in the presence of softening agents. The material can either be in the form of powder, flakes, fibers or an aqueous suspension, e.g., a latex dispersion. Examples of thermoplastic polymers are polyolefines such as polyethylene and polypropylene, polyesters etc. The material can either be supplied to the entire paper web or only to the portions thereof that are intended to be located closest to the heated roll 13.

By adding to the paper web said material, which is brought to soften or melt, there is achieved an increased amount of bonding sites in the paper web. By this the basis weight variation and three-dimensional structure, that has been imparted to the paper web in connection with the combined drying and press moulding, is effectively permanented. This structure is maintained also in the wet condition of the paper.

Paper can be produced by a number of different pulp types. If one disregards recovery pulp, which today is used to a great extent mainly for toilet paper and kitchen rolls, the most commonly used pulp type for soft paper is chemical pulp. The lignin content in such pulp is practically zero and the fibers, which mainly consist of pure cellulose, are relatively thin and flexible. Chemical pulp is a low yield pulp since it gives a yield of only about 50% calculated on the wooden raw material used. It is therefore a relatively expensive pulp.

It is therefore common to use cheaper so called high yield pulps, e.g., mechanical, thermomechanical pulp, chemomechanical pulp (CMP) or chemothermomechanical pulp (CTMP) in soft paper as well as in other types of paper, e.g., newsprint paper, cardboard etc. In high yield pulps the fibers are coarser and contain a high amount of lignin, resins and hemicellulose. The lignin and the resins gives the fibers more hydrophobic properties and a reduced ability ro form hydrogen bonds. The addition of a certain amount of chemothermomechanical pulp in soft paper has due to the reduced fiber-fiber bonding a positive effect on properties like bulk and absorption capacity.

A special variant of chemothermomechanical pulp (CTMP) is so called high temperature chemothermomechanical pulp (HT-CTMP), the production of which differs from the production of CTMP of conventional type mainly by using a higher temperature for impregnation, preheating and refining, preferably no lower than 140° C. For a more detailed description of the production method for HT-CTMP reference is made to WO 95/34711. Characterizing for HT-CTMP is that it is a long fibrous-, easily dewatered- and bulky high yield pulp with a low shives content and low fines content.

It has according to the invention been found that high yield pulp is especially suitable for impulse drying since it is pressure insensitive, easily dewatered and has an open structure which admits the generated steam to pass through. This minimizes the risk for the paper to be overheated and destroyed during the impulse drying, which is performed at considerably higher temperatures than in other drying methods. The pressure insensitivity and the open structure depends on that the fibers in high yield pulp are relatively coarse and stiff as compared to the fibers in chemical pulp.

A further advantage is that the three-dimensional pattern and the creping structure given the paper is essentially maintained also in wet condition of the paper, since it is imparted to the wet paper web in connection with drying thereof. Impulse drying further takes place at a considerably higher temperature than, e.g., Yankee drying or through-air-drying, at which according to a theory, to which however the invention is not bound, the softening temperature of the lignin present in the high yield pulp is reached during the simultaneous impulse drying and press moulding. When the paper becomes cooler the lignin stiffens again and contributes in permanenting the three-dimensional structure that has been given the paper. This is therefore essentially maintained also in the wet condition of the paper, which strongly improves the bulk and absorption qualities of the paper.

According to an embodiment of the invention the wet paper web is before said press nip exerted to a creping- or other foreshortening procedure which shortens the length of the paper web. This creping is a wet creping as the paper web at the creping is still wet or at least moist. This wet creping will result in a very fine creasing of the paper web, which is essentially maintained also in the dried paper web. By this the extensibility and toughness of the paper in the machine direction is improved.

According to one embodiment of the invention the paper contains a certain amount of a high yield pulp, said amount should be at least 10 weight % calculated on the dry fiber weight, preferably at least 30 weight % and more preferably at least 50 weight %. Admixture of a certain amount of another pulp with high strength properties, such as chemical pulp, preferably long-fibrous kraft pulp, or recycled pulp, is an advantage if a high strength of the paper is aimed at. The invention is however not bound to the use of a certain type of pulp in the paper, but can be applied with any optional pulp type or mixture of pulp types.

According to a further embodiment of the invention the paper web 10 can in connection with forming and dewatering be given a variation in basis weight in a non-random pattern. This can for example be provided by forming and dewatering the paper web on a wire, belt or band the dewatering capacity of which varies according to a certain pattern and where the differences in dewatering capacity involves a certain displacement of fibers and by that a local change of the basis weight of the paper web.

The basis weight variation that is given the paper web 10 in connection with forming and dewatering is permanented in the subsequent drying step, at which the structure is essentially maintained also in the wet condition of the paper.

According to a further embodiment of the invention the paper web has a varying material composition as seen in its thickness direction, in such a way that it at least in the layer(s) that will be located closest to heated roll 13 in connection with the drying contains a certain amount of a material which softens, melts or hardens in the temperature interval 100–400° C. By this the paper will get a surface layer which contributes in reinforcing the structural stability of the paper also in wet condition. The pulp composition in the rest of the paper layers can on the other hand be chosen for optimizing other properties such as softness, strength, bulk and draping qualities.

Said material which in connection with drying in the press nip softens, melts or hardens can consist of a wet strength agent, synthetic or natural polymers with thermoplastic properties, chemically modified lignin and/or synthetic or natural polymers in the presence of softening agents or of a lignin-containing high yield pulp.

Common additives such as wet strength agents, softening agents, fillers etc may of course also be used in the paper. The paper web can after drying in the press nip undergo different types of per se known treatments such as addition of different chemicals, further embossing, lamination etc.

What is claimed is:

1. A device for producing a paper having a three dimensional pattern of alternating raised and recessed portions, which has been provided in connection with drying of a wet paper web, said device comprising at least one press nip comprising a rotatable heated roll and a counter, at which either the heated roll along its periphery alternatively a member surrounding the roll or a patterned wire, band or belt is provided with said three dimensional pattern, and wherein the wet paper web is intended to pass through said press nip and is given said pattern, wherein a detaching roll is arranged at a certain distance from the press nip for taking off the paper web from the heated roll, and that creping means are arranged for creping the paper from said detaching roll.

2. A device as claimed in claim 1, wherein the angular distance, with respect to the heated roll, between the press nip and the detaching roll is at least 45°.

3. A device as claimed in claim 1, wherein the detaching roll is heated.

4. A device as claimed in claim 1, wherein the angular distance, with respect to the heated roll, between the press nip and the detaching roll is at least 60°.

* * * * *